United States Patent [19]

Adly

[11] Patent Number: 4,639,342

[45] Date of Patent: Jan. 27, 1987

[54] COMBINED CONCRETE FEED AND PACKERHEAD LIFT CONTROL

[75] Inventor: Tarek A. Adly, Nashua, Iowa

[73] Assignee: Hydrotile Machinery Company, Nashua, Iowa

[21] Appl. No.: 823,160

[22] Filed: Jan. 27, 1986

Related U.S. Application Data

[63] Continuation-in-part of Ser. No. 619,748, Jun. 11, 1984, abandoned.

[51] Int. Cl.[4] ..... B28B 7/18; B28B 13/02; B28B 21/10

[52] U.S. Cl. ..... 264/40.1; 264/312; 425/145; 425/150; 425/262; 425/427

[58] Field of Search ..... 264/40.4, 40.7, 267, 264/312, 40.1; 425/145, 262, 418, 426, 427, 457, 150

[56] References Cited

U.S. PATENT DOCUMENTS

| | | | |
|---|---|---|---|
| 3,551,968 | 1/1971 | Fosse et al. | 425/431 |
| 3,619,872 | 11/1971 | Fosse | 425/426 |
| 3,746,494 | 7/1973 | Gauger | 425/262 |
| 4,336,013 | 6/1982 | Hand | 425/145 |
| 4,340,553 | 7/1982 | Fosse | 264/40.7 |
| 4,406,605 | 9/1983 | Hand | 425/145 |
| 4,407,648 | 10/1983 | Fosse | 425/457 |

OTHER PUBLICATIONS

Perry and Chilton, "Chemical Engineer's Handbook", 5th Ed., McGraw-Hill, 1973, pp. 22-70 to 22-73.

*Primary Examiner*—Jan Silbaugh
*Assistant Examiner*—Karen D. Kutach
*Attorney, Agent, or Firm*—Biebel, French & Nauman

[57] ABSTRACT

A method and apparatus for making concrete pipe having substantially uniform density throughout the length of the pipe has a packerhead which is rotated and lifted within a mold, and a conveyor for feeding concrete into the mold. A combined conveyor speed and packerhead lift control operates in response to the amount of power used to rotate the packerhead to slow the speed of the conveyor to a desired speed and change the lift speed of the packerhead when the load on the motor for rotating the packerhead exceeds a selected upper load limit or falls below a selected lower load limit.

15 Claims, 12 Drawing Figures

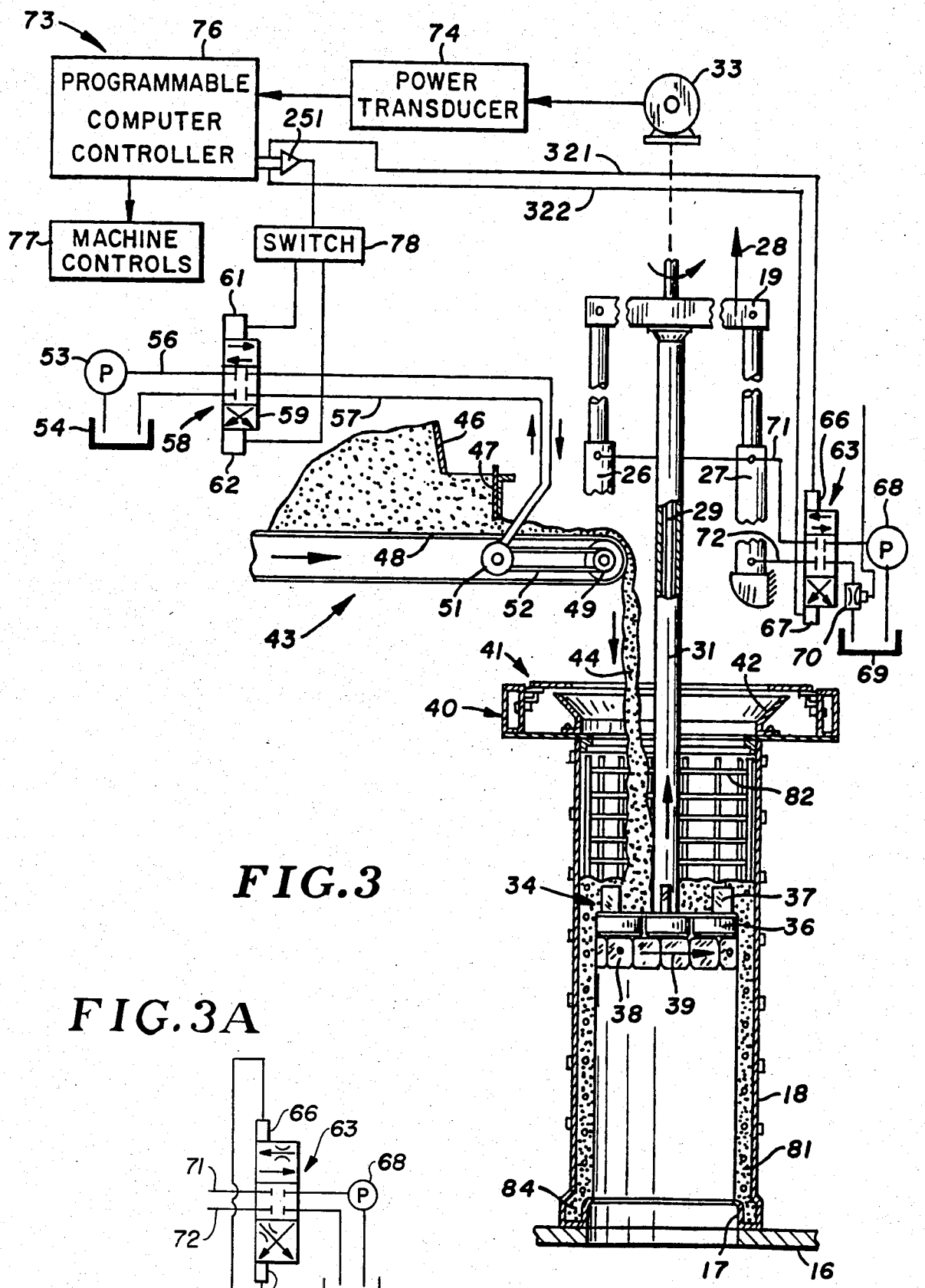
FIG.3
FIG.3A
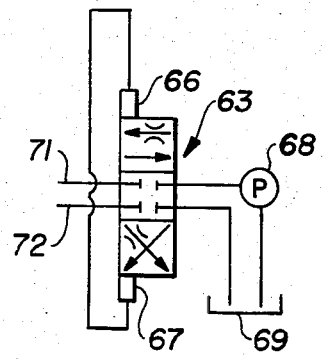

COMBINED CONCRETE FEED AND PACKERHEAD LIFT CONTROL

This application is a continuation-in-part of application Ser. No. 619,748 filed June 11, 1984, now abandoned.

TECHNICAL FIELD

The invention is in the field of concrete product making machines and controls therefor. The machines, known as packerhead concrete pipe making machines, have rotatable packerheads and conveyors for moving concrete into molds. The controls regulate the speed of the conveyor and the lift speed of the packerhead to form concrete pipes having uniform density throughout the length of the pipes.

BACKGROUND OF THE INVENTION

Conventional packerhead concrete pipe making machines are equipped with rotatable packerheads that are moved in an upward direction in molds to form concrete pipes. Conveyors are used to move concrete from hoppers into the molds. Manually operated controls have been used to regulate the speed of the conveyors to control the amount of concrete that is discharged into the molds. The manual control of the feeding of the concrete into the molds requires considerable experience to produce acceptable concrete pipe. Manual controls result in generally erratic packing conditions and nonuniform concrete packing throughout the length of the pipe. The manual controls are not susceptible to accurate termination of the concrete feed during the forming of the spigot end of the pipe. The spigots are soft with an insufficient supply of concrete or are overpacked with an oversupply of concrete.

An automatic concrete feed control for packerhead-type machines is disclosed in Fosse U.S. Pat. No. 3,619,872. This concrete feed control is responsive to the level of concrete accumulated above the packerhead in the mold. A sensing unit is used to sense the level of the concrete. The sensing unit includes a probe adapted to engage or otherwise determine when the top surface of the concrete is at a defined level above the packerhead. When the top surface of the concrete is thus sensed, an electrical switch is activated. The switch is part of the control circuit that regulates the operation of a motor that drives the concrete conveyor. The sensor is mounted on a stationary outer tube that supports the packerhead. The sensing units, while greatly improving the operation of packerhead pipe making machines, do present maintenance and operational problems.

For example, the consistency of the concrete mix fed into the molds varies from batch to batch. When a dry batch of concrete mix is fed into the molds, the packerhead can jam even though the level of the concrete remains the same. The level of dry concrete mixes must be lowered to achieve a desired compaction or concrete density. When the concrete mix is wet, a high level is needed to maintain the same packing action and concrete density. The concrete level sensing unit does not compensate for differences in the consistency of the concrete mix due to the amount of water as well as differences in aggregates used in the concrete mix.

An improved self-compensating concrete feed control system and method to maintain a substantially constant packing pressure and, hence, uniform wall density throughout the length of a pipe made on a packerhead machine are disclosed in Fosse, U.S. Pat. No. 4,340,553. The disclosed machine includes a counterrotating packerhead which includes upper and lower packerhead units and moves from the bottom to the top of a mold in a single pass operation to form a concrete pipe. A first motor is used to rotate the upper unit of the packerhead. The amount of concrete discharged into the mold is controlled in a manner to maintain a generally constant torque on the upper unit of the packerhead by sensing the power used by the first motor to rotate the upper unit of the packerhead and utilizing the sensed power to control the operation of a second motor which drives the concrete conveyor.

Electrical control systems have been developed to replace the hydraulic and mechanical controls disclosed in Fosse U.S. Pat. No. 4,340,553. Examples of electrical systems for controlling the concrete feed in packerhead pipe making machines are disclosed in Hand U.S. Pat. Nos. 4,336,013 and 4,406,605. These electrical control systems do not modulate the lift rate of the packerhead to self-compensate for overpack and underpack conditions which can occur during the formation of a concrete pipe in a packerhead machine. It is thus apparent that the need exists for a combined concrete feed and packerhead lift control system to compensate for overpack and underpack conditions which can otherwise occur along the sidewalls of a concrete pipe formed on packerhead machines available in the prior art.

SUMMARY OF THE INVENTION

The present invention is directed to a method and apparatus for controlling the functions of a packerhead concrete pipe making machine to overcome overpack and underpack conditions and thereby to ensure substantially uniform density of concrete throughout the length of a pipe made by the machine. The method is performed by apparatus having a packerhead which is rotated by a packerhead motor within a mold to form a concrete pipe. The packerhead is initially located in the lower end of the mold. Concrete is discharged into the mold on top of the packerhead such that when the packerhead is rotated and lifted, a cylindrical concrete pipe is formed. The power used by the packerhead motor to rotate the packerhead is sensed to generate a packerhead motor load signal which is related to the torque developed by the packerhead in forming the concrete pipe.

The rates of both concrete feed and packerhead lift are controlled to produce a pipe having substantially uniform density throughout the length thereof. The rate of concrete feed is controlled by varying the operating speed of a conveyor motor in response to the packerhead motor load signal. An upper limit and a lower limit of the packerhead motor load signal are selected to identify permissible limits of overpacking and underpacking, respectively. To maintain the packing between the permissible limits of overpacking and underpacking during normal machine operation, the lift speed of the packerhead is increased when the motor load signal exceeds the upper limit and decreased when the motor load signal falls below the lower limit. This interrelated control of the feed speed of the concrete conveyor and the lift speed of the packerhead produces a substantially uniform wall density throughout the length of pipe produced by a packerhead machine including the control method and apparatus of the present invention.

Control of the amount of concrete discharged into the mold is accomplished by comparing the packerhead motor load signal with a reference packerhead motor load signal. The reference packerhead motor load signal is empirically determined for a given machine and size of pipe to be made and manually selected by the machine operator prior to producing a run of pipe.

The packerhead motor load signal is compared to the reference packerhead motor load signal to generate an error signal whenever the two are different. If the packerhead motor load signal exceeds the reference packerhead motor load signal, the nature of the error signal causes a reduction in the speed of the concrete conveyor; if the packerhead motor load signal falls below the reference packerhead motor load signal, the nature of the error signal causes an increase in the speed of the concrete conveyor. The magnitude of the error signal and hence the changes effected in the speed of the concrete conveyor are determined by the difference between the two signals.

Control of the concrete conveyor maintains a substantially uniform packing density most of the time. However, changes during the operation of a packerhead machine, such as variations in the consistency of the concrete being fed to the mold, can lead to overpack and underpack conditions. In accordance with the present invention, the lift speed of the packerhead is varied from a selected base lift speed to supplement the control of the speed of the concrete conveyor if the packerhead motor load signal varies beyond selected upper and lower motor load limit reference signals to thereby overcome the overpack and underpack conditions. Preferably, the upper limit reference signal and lower limit reference signal correspond to a desired motor load plus a selected permissible overpack motor load portion or minus a selected permissible underpack motor load portion, respectively.

The packerhead motor load signal is compared to the upper and lower limit reference signals to identify overpack and underpack conditions. When the packerhead motor load signal exceeds the upper limit reference signal, the lift speed of the packerhead is increased to overcome the overpack condition and thereby to compensate for excess concrete above the packerhead.

When the packerhead motor load signal goes below the lower limit reference signal, the lift speed of the packerhead is decreased to overcome the underpack condition and thereby to allow additional concrete to be placed into the mold. Accordingly, the lift speed of the packerhead is selectively increased or decreased to supplement the changes in the speed of the concrete conveyor whenever the packerhead motor load signal exceeds the upper limit reference signal or falls below the lower limit reference signal to overcome overpack and underpack conditions and thereby to ensure the integrity and substantially uniform density of the wall of a concrete pipe formed by the packerhead machine. Preferably, the lift speed of the packerhead is controlled within a selectable range between a maximum lift speed and a minimum lift speed. Further, the control arrangement includes adjustable means which is set to correspond to the pipe size being produced such that if the packerhead lift speed is reduced to zero, the packerhead will remain substantially within the last part of the pipe being produced.

DESCRIPTION OF THE DRAWINGS

FIG. 3 is a diagrammatic view of the packerhead concrete pipe making machine and combined concrete feed and packerhead lift control of FIG. 1;

FIG. 3A shows a four-way proportional valve which may be used to control packerhead lift in the pipe making machine of FIG. 3;

DETAILED DESCRIPTION OF THE PREFERRED EMBODIMENTS

Figure 1:
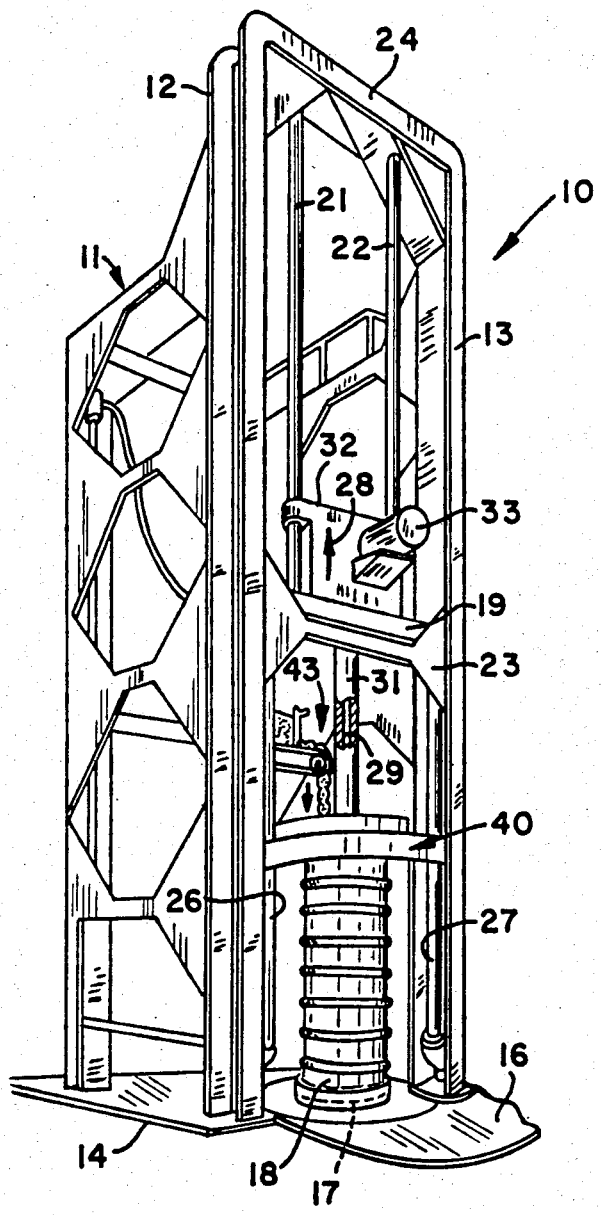
FIG. 1 is a perspective view of a packerhead concrete pipe making machine equipped with the combined concrete feed and packerhead lift control of the invention.
Figure 2:
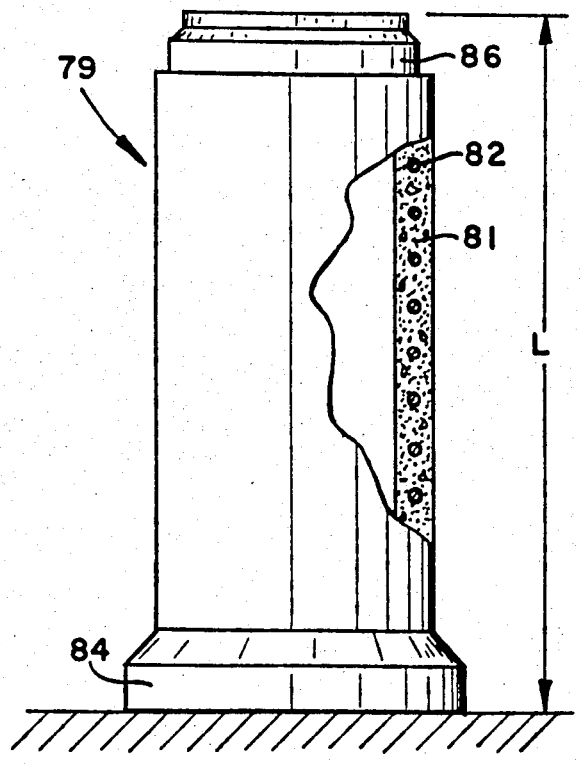
FIG. 2 is an elevational view, partly sectioned, of a concrete pipe of the type made by the machine of FIG. 1.

Referring to FIG. 1, a packerhead concrete pipe making machine 10 has an upright framework 11 comprising a number of upright beams and crossbeams including main upright front I-beams 12 and 13. The midportions of the beams 12 and 13 are secured to a crossbeam 23. A top crossbeam 24 is secured to the top of the beams 12 and 13. The beams and crossbeams of the framework are welded together to provide a strong unitary framework.

The machine 10 is supported on a base or floor 14 which carries a rotatable horizontal turntable 16, only a portion of which is shown in FIG. 1. The turntable 16 supports a plurality of pallets 17 and cylindrical jackets or molds 18 such that the pallets 17 and molds 18 can be rotated into the position shown in FIG. 1 to facilitate rapid operation of the pipe making machine 10.

A crosshead 19 extends horizontally between the beams 12 and 13 above the crossbeam 23. A pair of upright cylindrical guides 21 and 22 support the crosshead 19 for vertical movement between a first or lowered position as shown in FIG. 1 and a second or raised position adjacent the top crossbeam 24. The lower ends of the guides 21 and 22 are secured to the crossbeam 23, and the upper ends of the guides 21 and 22 are secured to the top crossbeam 24.

A pair of hydraulic packerhead lift cylinders 26 and 27 supported adjacent the lower ends of the beams 12 and 13 are attached to opposite ends of the crosshead 19. The lift cylinders 26 and 27 are double acting hydraulic fluid operated piston and cylinder assemblies operable to move the crosshead 19 and a packerhead 34 supported thereby along a path defined by the vertical guides 21 and 22 and indicated by an arrow 28, see FIG. 3. In large machines, each of the lift cylinders 26 and 27 can be replaced by pairs of lift cylinders to accommodate heavier loads. The cylinders 26 and 27 are supplied with hydraulic fluid, such as oil, under pressure by a pump 68, shown in FIGS. 3 and 6.

As shown in FIG. 3, the crosshead 19 supports a downwardly directed drive shaft 29 which is surrounded by a downwardly directed sleeve 31. The packerhead 34 is connected to the lower end of the drive shaft 29 and the upper end of the drive shaft 29 is connected to a power transmission (not shown) which is mounted on top of the crosshead 19. A motor 33, which can be either electrically or hydraulically powered, rotates the drive shaft 29 through the power transmission.

The packerhead 34 has a plurality of rollers 36, preferably five. Each roller 36 carries at least one upwardly directed fin or blade 37 for working and moving concrete in an outward direction against the inside wall of the mold 18. An annular trowel 38 is located below the rollers 36. The packerhead 34 is rotated in the direction of an arrow 39 by operation of the motor 33. The packerhead 34 is simultaneously rotated and lifted through the mold 18 to form a concrete pipe therein. The packerhead lift motion is controlled or modulated in accordance with the present invention to ensure substantially constant concrete packing pressure on the concrete deposited into the mold 18 as will be described hereinafter.

The machine 10 has a feeder table 40 located adjacent the top of the mold 18. The feeder table 40 supports a concrete feeding device 41 having a downwardly converging funnel or cone member 42. The concrete feeding device 41 is the subject matter of U.S. Pat. No. 3,551,968 which is incorporated herein by reference.

A conveyor 43 is operable to discharge concrete 44 through the feeder table 40 into the mold 18 above the packerhead 34. An endless belt 48 is driven by a drive roller 49 to move concrete 44 from a hopper or storage bin 46 to the mold 18. The outlet of the hopper 46 has an adjustable gate 47 located above the endless belt 48 to adjust the thickness of the concrete 44 carried by the conveyor 43 for various sizes of pipe.

A motor 51, shown in FIG. 3 as a hydraulic motor, is connected to the drive roller 49 by a belt or chain drive 52. The speed of the motor 51 is controlled to regulate the speed of the belt 48 and, hence, the amount of concrete 44 that is discharged into the mold 18 above the packerhead 34. While the motor 51 can be an electric motor, such as a D.C. electric motor, the illustrated hydraulic motor is operatively coupled to a pump 53 through hydraulic lines or hoses 56 and 57. The pump 53 delivers pressurized hydraulic fluid, such as oil, from a reservoir 54 to a proportional control valve assembly 58. The hydraulic lines 56 and 57 are connected to the proportional valve assembly 58, which includes a movable spool or valving member as is well known in the art.

A pair of solenoids 61 and 62 selectively position the valving member of the valve assembly 58 to control the amount of flow and the direction of flow of pressurized hydraulic fluid to the motor 51. The speed of the motor 51 is changed to regulate the operating speed of the conveyor belt 48 and thereby to control the amount of concrete 44 deposited into the mold 18. A second control valve assembly 63 is connected to hydraulic lines 71 and 72 leading to the opposite ends of the packerhead lift cylinders 26 and 27. A pump 68 is operable to draw hydraulic fluid, such as oil, from a reservoir 69 and to supply pressurized fluid to the valve assembly 63. A proportional valve 70 is interposed in the discharge line leading from the valve assembly 63 to the reservoir 69 for modulation of the packerhead lift rate.

The combination of the control valve assembly 63 and the proportional valve 70 may be replaced by a four-way proportional valve assembly 63A as shown in FIG. 3A. It is noted that either the valve assembly 63 and proportional valve 70 of FIG. 3 or the four-way proportional valve assembly 63A of FIG. 3A are provided for the pipe making machine 10. If the four-way proportional valve assembly 63A is provided, the speed control signals are directly applied to the solenoids 66 and 67 for modulation of the packerhead lift rate as will be described hereinafter.

The valve assembly 63 or 63A receives a movable spool or valving member. The position of the valving member is controlled by a pair of solenoids 66 and 67 to regulate the supply of hydraulic fluid to the lift cylinders 26 and 27 and the return of hydraulic fluid therefrom. The proportional valve 70 or proportional valve assembly 63A has an infinitely variably positioned valving member for controlling hydraulic fluid flow as directed by control signals from a control means or system 73.

The control system 73 includes a programmable computer controller 76 and is operable to coordinate the entire operation of the machine 10 in a manner to form concrete pipes. The computer controller 76 generates output command signals which operate machine controls 77, such as automatic cycling of the operations, including bell feed, adding bell water, making a controlled first pass, operating the table top wiper, stopping the concrete flow at the top of the pipe and second pass operations as is well known in the art.

In addition, the control system 73 has been modified in accordance with the present invention to control the rate of lift of the packerhead 34 to supplement the control of the concrete feed conveyor 43 to overcome excessive overpack and underpack conditions and thereby to ensure substantially uniform concrete compaction and density throughout the length of a pipe as will be described. While the present invention is described with reference to a computer control system, it will be apparent to those skilled in the art that the present invention can be incorporated into almost any packerhead machine control system.

The control system 73 has a power transducer 74 providing motor load signals to the computer controller 76. The power transducer 74 is a Hall effect watt transducer which generates an analog motor load output signal voltage varying between 0 and 10 volts. A representative power transducer is marketed by Ohio Semitronics, Inc. of Columbus, Ohio. A representative computer controller is marketed by the Allen Bradley Company of Milwaukee, Wis. as an Allen Bradley PLC Family controller. Other types and models of power transducers and programmable computers can be used in the control system 73 of the present invention as will be apparent to those skilled in the art.

The control system 73 regulates the speed of the conveyor 43 according to the torque applied to the packerhead 34 as is well known in the art. However, the flow of concrete 44 from the hopper 46 and movement of concrete 44 by the conveyor 43 tends to be nonuniform, due to differences in the level of concrete in the hopper 46 and variations in the concrete mix caused, for example, by the type of aggregate used and the moisture content of the concrete mix. Accordingly, in addition to the control of the speed of the conveyor 43, the lift rate of the packerhead 34 is varied by the control system 73 of the present invention if the torque applied to the packerhead 34 exceeds selected limits indicating excessive overpacking or underpacking of the concrete.

The output signals of the power transducer 74 represent the amount of power that is used by the motor 33 to rotate the packerhead 34. Since the amount of power used by the motor 33 is a function of the torque required to rotate the packerhead 34 during the pipe forming process, the output signals of the power transducer 74 are a function of the torque applied to the packerhead 34. Hence, as is well known in the art, the output signals of the power transducer 74 are also a function of the concrete packing pressure established by the packerhead 34 during the formation of the concrete pipe 81. The analog output signals from the transducer 74, which vary from 0 to 10 volts, correspond, respectively, to zero torque and maximum torque.

Figures 4, 4A:
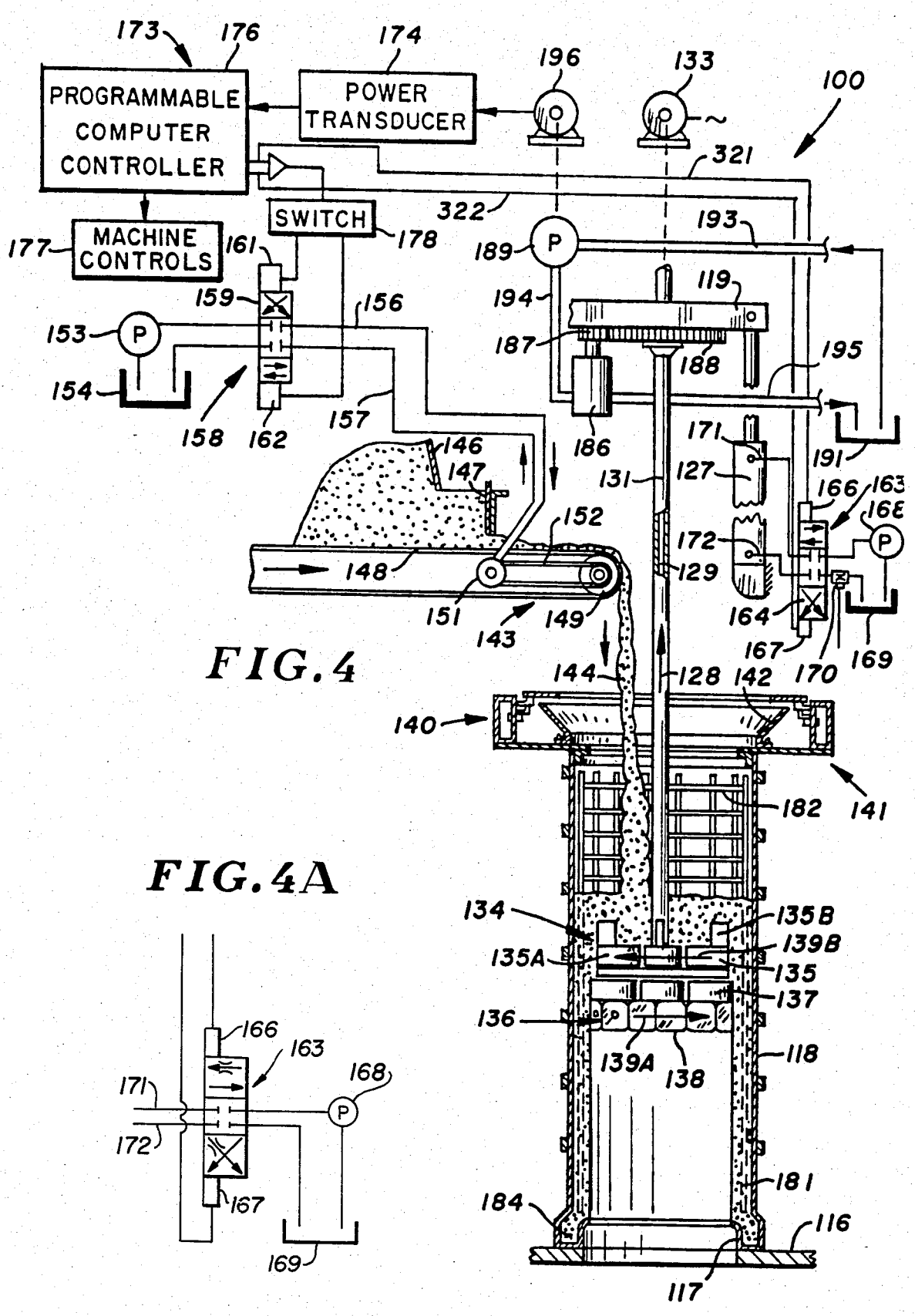
FIG. 4 is a diagrammatic view of a packerhead concrete pipe making machine having a counterrotating packerhead and the combined concrete feed and packerhead lift control of the invention.
FIG. 4A shows a four-way proportional valve which may be used to control packerhead lift in the pipe making machine of FIG. 4.

FIG. 4 shows diagrammatically a counterrotating packerhead concrete pipe making machine 100 of the type disclosed in Fosse U.S. Pat. No. 4,340,553, which is incorporated by reference. The machine 100 comprises a framework 111 like that of the machine 10 and including a crosshead 119 and lift cylinders 127 (only one being shown) for moving the crosshead assembly vertically as shown by an arrow 128.

A counterrotating packerhead assembly 134 includes an upper packerhead unit 135 and a lower packerhead unit 136. The upper packerhead unit 135 has a plurality of circumferentially spaced rollers 135A carrying upwardly directed blades or fins 135B. The lower packerhead unit 136 has a plurality of rollers 137 and an annular trowel 138.

A shaft 129 depends from the crosshead 119 through a sleeve 131. The shaft 129 supports the lower packerhead unit 136 and is driven by a motor 133 at its upper end to rotate the lower packerhead unit 136 in the direction of an arrow 139A. The sleeve 131 supports the upper packerhead unit 135 which is rotated in the opposite direction as indicated by an arrow 139B by a hydraulic motor 186 through a gear train power transmission 187, 188 and the sleeve 131. While the motors 133 and 186 could be either electric or hydraulic, as illustrated in FIG. 4, the motor 133 is electric and the motor 186 is hydraulic.

A feeder table 140 includes a table wiper assembly 141 which is located above the mold 118. The wiper assembly 141 includes a downwardly directed funnel 142 which directs concrete 144 into the mold 118. The feeder table wiper assembly 141 is part of a feeding device that is the subject of U.S. Pat. No. 3,551,968, which is hereby incorporated by reference.

A conveyor 143 delivers the concrete 144 to the mold 118 from a hopper 146 on a continuous belt 148 which moves under a hopper gate 147. The belt 148 is trained over a drive roller 149 connected to a motor 151 by a belt or chain 152. As shown in FIG. 4, the motor 151 is hydraulic and is supplied with hydraulic fluid under pressure by a pump 153 which has an input line coupled to a reservoir 154 and an output line 156 connected to the motor 151. A return line 157 carries hydraulic fluid from the motor 151 back to the reservoir 154.

A solenoid operated proportional valve assembly 158 is interposed in the hydraulic lines 156 and 157 and includes a body 159 and a movable spool or valving member. Solenoids 161 and 162 control the position of the valving member and thereby control the flow of hydraulic fluid to the motor 151 and regulate the speed of operation of the conveyor 143.

A second pump 189 is driven by an electric motor 196 to draw hydraulic fluid from a reservoir 191 through a hydraulic line 193 and discharge the fluid under pressure to a hydraulic line 194 connected to the hydraulic motor 186. Hydraulic fluid under pressure from the pump 189 operates the motor 186 to rotate the upper packerhead unit 135. Hydraulic fluid from the motor 186 is discharged back to the reservoir 191 through a hydraulic line 195.

A power transducer 174, which is the same as the power transducer 74 identified above, is operable to sense the power used by the motor 196 and to generate a motor load signal that is passed to a computer controller 176 which is the same as the computer controller 76 identified above. The computer controller 176 generates output signals which control the operation of the proportional valve assembly 158 and thereby control the discharge of concrete 144 into the mold 118 in accordance with the sensed power used by the motor 196. Since the motor 196 drives the pump 189, the power used by the motor 196 is a function of the hydraulic pressure generated by the pump 189, and which in turn is a function of the torque applied to the upper packerhead unit 135 during formation of the pipe 181.

The packerhead assembly 134 is moved in an upward direction in the mold 118 by the hydraulic cylinders 127 while the upper packerhead unit 135 and the lower packerhead unit 136 are counterrotating. A control valve assembly 163 connects a pump 168 to opposite ends of the cylinders 127. The valve assembly 163 has a body 164 which includes a spool or valving member.

A pair of solenoids 166 and 167 control the operation of the valve 163. A proportional valve 170 is interposed in the discharge line leading from the valve assembly 163 to a reservoir 169 to thereby control the speed of the upward movement or lift of the packerhead assembly 134, as well as its downward movement. The combination of the control valve assembly 163 and the proportional valve 170 may be replaced by a four-way proportional valve assembly 163A as shown in FIG. 4A. It is noted that either the valve assembly 163 and proportional valve 170 of FIG. 4 or the four-way proportional valve assembly 163A of FIG. 4A are provided for the pipe making machine 100. If the four-way proportional valve assembly 163A is provided, the speed control signals are directly applied to the solenoids 166 and 167 for modulation of the packerhead lift rate as will be described hereinafter.

The output signals from the power transducer 74 are fed to the computer controller 76 and the output signals from the power transducer 174 are fed to the controller 176. The computer controllers 76 and 176 are programmed to control a two-pass packerhead machine and a one-pass counterrotating packerhead machine, respectively. While these programs are different to accommodate the obvious differences in the machines, the present invention is applicable to both types of machine, as will become apparent.

The output signals from the power transducers 74 and 174 are processed by the computer controllers 76 and 176, respectively, as will be described. Since the computer controllers 76 and 176 are substantially the same except for programming to control a two-pass packerhead machine and a one-pass counterrotating packerhead machine, respectively, the invention will be described primarily with reference to the two-pass machine of FIG. 3. Accordingly, the computer controller 76 and proportional valve assemblies 58 and 63A are shown in the schematic diagrams of FIGS. 5 and 6.

Variations for control of the one-pass counterrotating packerhead machine of FIG. 4 will be mentioned with reference to the schematic diagrams where necessary. The potentially dual control of both type machines is suggested by the inclusion of the motor 196 and the power transducer 174 in the circuit diagram of FIG. 5. Various other components have been included to illustrate dual control, as will become apparent.

The analog output signal from the power transducer 74 (or 174) is passed to the computer controller 76 where it is converted to digital signals. The computer controller 76 also receives analog signals from a pair of potentiometers 201 and 202. The analog signal from the potentiometer 201 defines the reference motor load/packing pressure for the first pass of the packerhead through the mold, and the analog signal from the potentiometer 202 defines the reference motor load/packing pressure for the second pass, if required. The analog signals from the potentiometer 201 also define the motor load/packing pressure for the single pass counterrotating packerhead machine shown in FIG. 4, and the potentiometer 202 can be eliminated from the control systems of such machines. It is also noted that the second pass oftentimes is not necessary when a packerhead machine is controlled in accordance with the invention of the present application.

Figure 5:
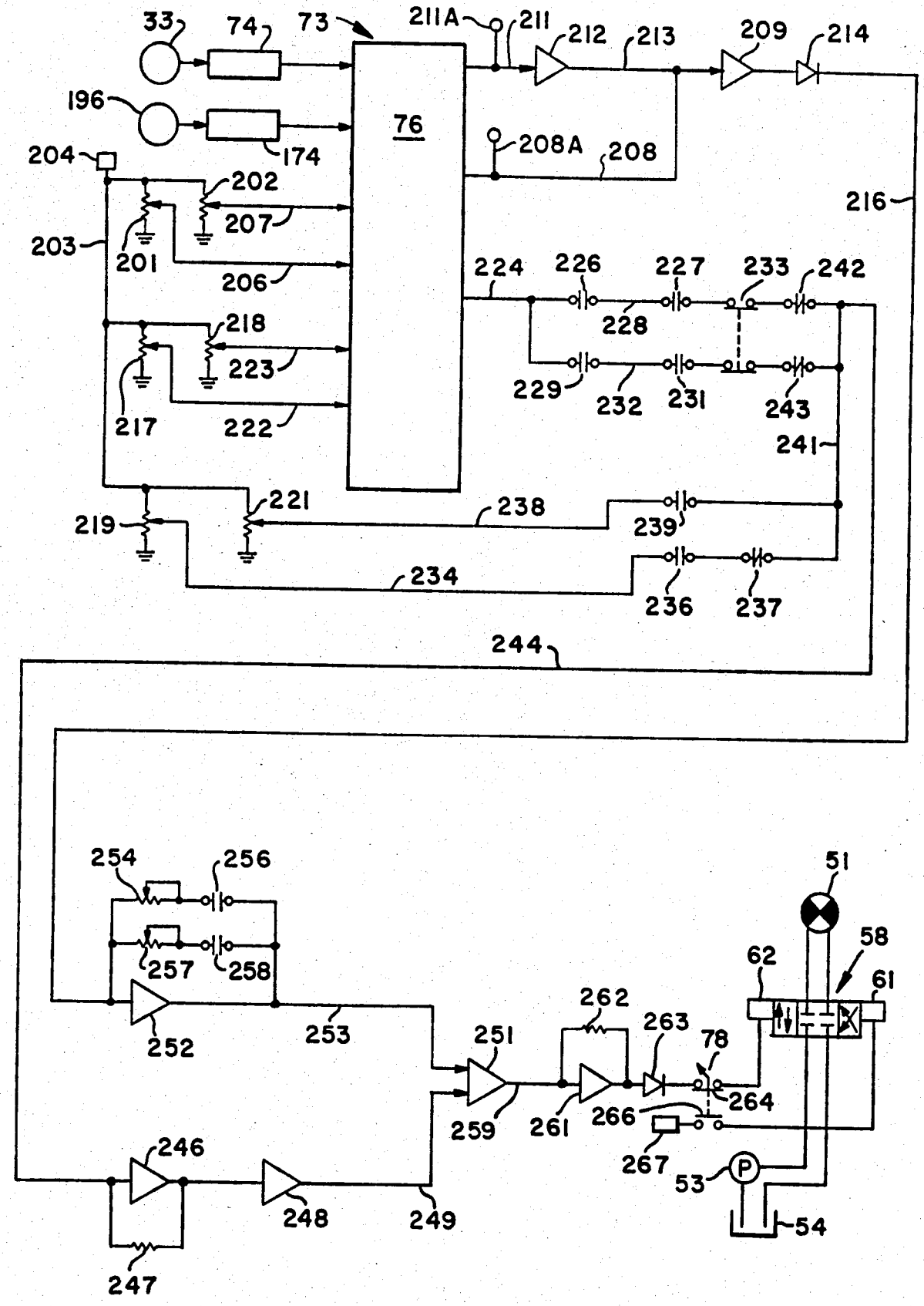
FIG. 5 is a schematic diagram of the concrete feed control section of the combined concrete feed and packerhead lift control.

As shown in FIG. 5, the potentiometers 201 and 202 are connected through a conductor 203 to a positive power supply 204. Adjustment of the potentiometers 201 and 202 generates analog output signals varying from 0 to 10 volts and representing 0 to 100% motor load, respectively. Conductors 206 and 207 connect the analog output signals from the potentiometers 201 and 202 to an I/O interface to the computer controller 76.

The signal from the potentiometer 201 defines a reference motor load which is the desired motor load to be maintained during the first pass of a two-pass packerhead machine or the single pass of a counterrotating packerhead machine. The output signal from the potentiometer 202 defines a reference motor load which is the desired motor load to be maintained during the second pass of a two-pass packerhead machine. The computer controller 76 may be programmed to control either a single pass counterrotating packerhead machine, as shown in FIG. 4, or a dual pass packerhead machine as shown in FIG. 3, or, with sufficient storage capacity in the computer controller 76, it can be programmed to control selectively either type of packerhead machine, with the operating mode of the control being selected by the operator of the machine.

The analog output signals or reference motor load signals from the potentiometers 201 and 202 are converted to digital BCD signals by an I/O interface to the computer controller 76. The computer controller 76 then selects one or the other signal dependent upon the type of packerhead machine being controlled and the particular point in the operation of the machine at that time. The selected signal is passed to an I/O interface which recreates the corresponding analog reference motor load signal on a conductor 208.

It should be noted that the computer controller 76 could control an external switch for directly selecting the signal from one of the potentiometers 201 and 202. However, conversion of the signals from the potentiometers to a digital form which can be operated upon by the computer controller 76 permits range changes or other operations to be performed on the signals if necessary or desirable for the operation of the packerhead machine.

The actual motor load signal generated by the power transducer 74 (or 174) is also passed to an I/O interface to the computer controller 76 and converted to digital BCD signals. The computer controller 76 then passes the digital BCD signals to an I/O interface which recreates the corresponding analog signal generated by the power transducer 74 (or 174) on a conductor 211. Here again, the conversion of the analog actual motor load signal adds versatility to the system, but is not absolutely necessary.

Since the desired motor load signal from the potentiometer 201 or 202 should ideally correspond to the actual motor load signal, the difference between the two is an error signal which can be used to control the concrete conveyor 43 (or 143) of the associated packerhead machine. To this end, the actual motor load signal on the conductor 211 is inverted by an operational amplifier 212 and passed to a summing amplifier 209 via a conductor 213. The summing amplifier 209 also receives the reference motor load signal on the conductor 208 and determines the algebraic sum of the two signals. The resulting algebraic sum is inverted by the summing amplifier 209 and passed to a diode 214.

If the positive reference motor load signal on the conductor 208 is greater than the negative actual motor load signal on the conductor 213, the algebraic sum of the two signals is positive, and hence the output signal of the inverting operational amplifer 209 is negative such that no signal is passed through the diode 214. On the other hand, if the negative actual motor load signal on the conductor 213 exceeds the positive reference motor load signal on the conductor 208, a negative algebraic sum results which, after inversion by the summing amplifier 209, results in a positive error signal on the output of the amplifer 209 that is passed through the diode 214 to the input of an operational amplifier 252 by means of a conductor 216. Hence, an error signal equal to the difference between the preset reference motor load signal and the actual motor load signal is passed through the diode 214 only when the actual motor load signal is larger than the preset reference motor load signal.

Four potentiometers 217, 218, 219 and 221 are connected to the power source 204 via the conductor 203 to generate positive analog output signals varying between 0 and 10 volts. The output signals from the potentiometes 217, 218, 219 and 221 define preset speeds for the concrete conveyor 43 (or 143) of a packerhead pipe making machine being controlled. The positive output signals from the potentiometers 217, 218, 219 and 221 correspond to 0 to 100% of the conveyor speed as they vary from 0 to 10 volts, respectively.

The potentiometers 217 and 218 preset the conveyor speed during formation of the barrel of a concrete pipe for the first pass and second pass operations, respectively, of a two-pass machine. Here again, potentiometer 217 is also used for the single pass of a counterrotating packerhead machine which may permit the elimination of the potentiometer 218 in the event that only a single pass counterrotating machine is to be controlled. The output signals from the potentiometers 217 and 218 are passed to the computer controller 76 via conductors 222 and 223, respectively.

The output signals from the potentiometers 217 and 218 are set to select a conveyor speed which is faster than the ideal speed required to make a selected concrete pipe. The selected overspeed for the concrete conveyor is illustrated by an inclined line 220 in FIG. 8 which represents the motor load that would result if concrete were fed to a packerhead machine at the rate which is preselected by the potentiometer 217 for the first pass of a dual pass machine or the single pass of a counterrotating machine.

Since the potentiometer 217 is directed to the first pass of a two-pass machine or the single pass of a counterrotating packerhead machine, the speed of the conveyor set by potentiometer 217 is much faster than the speed set by the potentiometer 218. Since little concrete is actually applied during the second pass of a two-pass machine, the potentiometer 218 is set at a value which causes the concrete conveyor to operate at a relatively slow speed by comparison to the conveyor speed during the first pass of a two-pass machine.

The computer controller 76 superimposes a pulsating signal on the selected one of the conveyor speeds set by the potentiometers 217 and 218 by superimposing a square wave of approximately 0.1 volt at a frequency of approximately 75 to 100 hertz. The pulsating square wave superimposed onto the control signals from the potentiometers 217 and 218 constantly vibrates the valve spool of the proportional control valve 58 when applied to the solenoid 62 which controls the valve for forward operation of the conveyor 43 (or 143). This pulsation compensates for frictional losses encountered when the spool is moved inside the proportional control valve 58 and decreases the response time of the valve.

After selecting the appropriate analog signal from either potentiometer 217 or 218 and superimposing a pulsating signal thereon as described, the computer controller 76 routes the resulting concrete conveyor output signal to a conductor 224. The output signal on the conductor 224 is passed to a conductor 244 through a series of relay contacts and switch contacts which perform logical operations defining various steps or phases in the operation of the packerhead machine controlled by the control system including the computer controller 76. The relays are operated by the computer controller 76 or by other automatic control circuitry. While the relay/switch logic is not relevant to the present invention and will be apparent to those of ordinary skill in the art, the relays and switches which operate the illustrated contacts will be identified to make their significance apparent.

In the event that a two-pass machine is controlled, the signals from the potentiometer 217 and 218 are selected for the first and second passes, respectively. Accordingly, the upper relay contact path including the contacts 226, 227 and 242 and the switch contact 233 define the first pass of a two-pass machine, while the contacts 229, 231, 233 and 243 define the second pass for a two-pass machine. In particular, the normally open contacts 226 are closed during the first pass phase of the operation of a two-pass machine, the normally open contacts 227 are closed while concrete is being fed to form the barrel of a pipe, the normally closed switch contacts 233 correspond to a manual switch which the operator controls to switch the machine from automatic to manual control, and the normally closed contacts 242 are on a relay which is also operated for manual control. The normally open relay contacts 229 are closed during the second pass phase of the operation of a two-pass machine, while the normally open contacts 231 again correspond to the feeding of concrete for the formation of the barrel portion of a concrete pipe, and the normally closed switch contacts 233 and relay contacts 243 again correspond to manual operation of the packerhead machine being controlled.

The output signal from the potentiometer 219 controls the speed of the concrete conveyor for conveying concrete to a mold during formation of the bell of a concrete pipe. The bell feed control signal from the potentiometer 219 is not processed by the computer controller 76 and is preset to a predetermined value for each size of pipe to be manufactured. A preset time is also used to control the volume of concrete which is required for the bell of a pipe. The output signal from the potentiometer 219 is passed to normally open contacts 236 of a bell feed relay which is operated during the formation of the bell of a pipe. The output signal from the potentiometer 219 also must pass through normally closed contacts 237 which are operated by a manual feed relay in the event the operator of the machine selects to control its operation manually.

The output signal from the potentiometer 221 is used to control manually the speed of the concrete feed conveyor 43 (or 143) when manual control is selected by operation of the switch 233 and a corresponding manual control relay (not shown) which controls normally open contacts 239 and normally closed contacts 237, 242 and 243. The output signals from the potentiometers 219 and 221 are connected to the conductor 244 by means of a conductor 241.

The conductor 244 carries a conveyor speed control signal which originates from a selected one of the potentiometers 217, 218, 219 and 221 to the input of an operational amplifer 246 which includes a resistor 247 in a feedback path. As shown in FIG. 5, the operational amplifier 246 is an inverting amplifier, and hence a second inverting amplifier 248 having unitary gain inverts the output signal from the operational amplifier 246 and passes it to a conductor 249. The conductor 249 carries the resulting positive output signal from the operational amplifier 248 to a summing amplifier 251.

As previously described, the difference or error signal corresponding to the amount by which the actual motor load exceeds the reference motor load, as selected by adjustment of the potentiometer 201 or 202, is passed to the operational amplifier 252 via the conductor 216. The operational amplifier 252 amplifies and inverts the difference or error signal received on the conductor 216 by an amount which is dependent upon which one of two potentiometers 254 and 257 is connected into a feedback path for the amplifier 252. The potentiometer 254 is connected into the feedback path of the amplifier 252 by normally open relay contacts 256 which are closed during the first pass of a two-pass machine or the single pass of a counterrotating packerhead machine. The potentiometer 257 is connected into the feedback path of the amplifier 252 by normally open contacts 258 which are closed during the second pass of the operation of a two-pass packerhead machine.

The potentiometers 254 and 257 provide individual adjustment of the gain or sensitivity of the amplifier 252 to define the change in volume of the concrete provided to the mold per second for a given difference or error signal received on the conductor 216. Hence, the potentiometer 254 may be adjusted to provide an amplification factor signifying an increase of 5 cubic feet per second of concrete volume delivered to the mold for a given voltage differential in the difference or error signal provided on the conductor 216, while the potentiometer 257 might be adjusted to provide only 1 cubic foot per second change in the concrete provided to the mold for the same voltage differential change of the signal on the conductor 216 for the second pass. It is noted that the potentiometers 254 and 257 may also be adjusted to accommodate varying sizes of pipe since during the manufacture of larger sized pipes, greater changes in the volume of concrete provided per second to the mold for given changes in the difference or error signal on the conductor 216 may be required.

The summing amplifier 251 algebraically combines the positive signal on the conductor 249 with the negative signal on the conductor 253 and inverts the resulting signal which is passed to the conductor 259. The signal on the conductor 259 defines the speed at which the concrete conveyor 43 (or 143) is to be driven as defined by the selected conveyor speed initially set by one of the potentiometers 217 or 218 reduced by the error or difference signal by which the actual motor load signal exceeds the reference motor load signal as provided on the conductor 216 and as modified by the amplifier 252.

The negative output signal from the operational amplifier 251 on the conductor 259 is amplified and inverted by an operational amplifier 261 and passed through a diode 263 to drive the solenoid 62 of the hydraulic valve assembly 58. A resistor 262 is selected for the feedback path of the amplifier 261 to adjust its output signal levels to correspond to the voltage requirements of the proportional valve assembly 58.

The output signal from the operational amplifier 261 is passed through contacts 264 of a switch 78 to the solenoid 62 for normal forward operation of the concrete conveyor 43 (or 143) of a packerhead machine. When the concrete conveyor 43 (or 143) is required to run in the reverse direction for cleaning purposes, the switch 78 is operated to close contacts 266 and open the contacts 264 such that a DC power supply 267 is connected to the solenoid 61 and the output signals from the operational amplifier 261 are disconnected from the solenoid 62. This causes a reverse flow of hydraulic fluid to the motor 51 to operate the concrete conveyor in the reverse direction. The switch 78 is returned to its normal position, i.e., to close the contacts 264 and open the contacts 266, when the machine is to be returned to operation.

The proportional valve 58 is controlled by a direct current (DC) voltage or analog signal. The valve is controlled such that the quantity of hydraulic fluid flowing through the valve to the motor 51 corresponds linearly to the DC voltage or analog signal supplied to the solenoid 61 or 62. The proportional valve 58 has an internal hydraulic feedback path which allows a constant flow of hydraulic fluid for a given control signal applied to one of its solenoids 61 or 62.

As can be seen from the above description of the control of the concrete conveyor for a packerhead machine, the conveyor is set initially to "over speed", i.e., to a speed faster than that desired, by means of adjustment of a signal generating device, such as a potentiometer, and then the conveyor is throttled back in response to difference or error signals indicating that the actual load of the motor rotating the packerhead of the machine exceeds a reference motor load which is preset by the operator of the machine by means of adjustment of a signal generating device, such as a potentiometer. Signals indicating that the reference motor load exceeds the actual motor load are blocked such that the conveyor speed will tend toward the over speed condition preset by the operator of the machine in that event.

Figure 6:
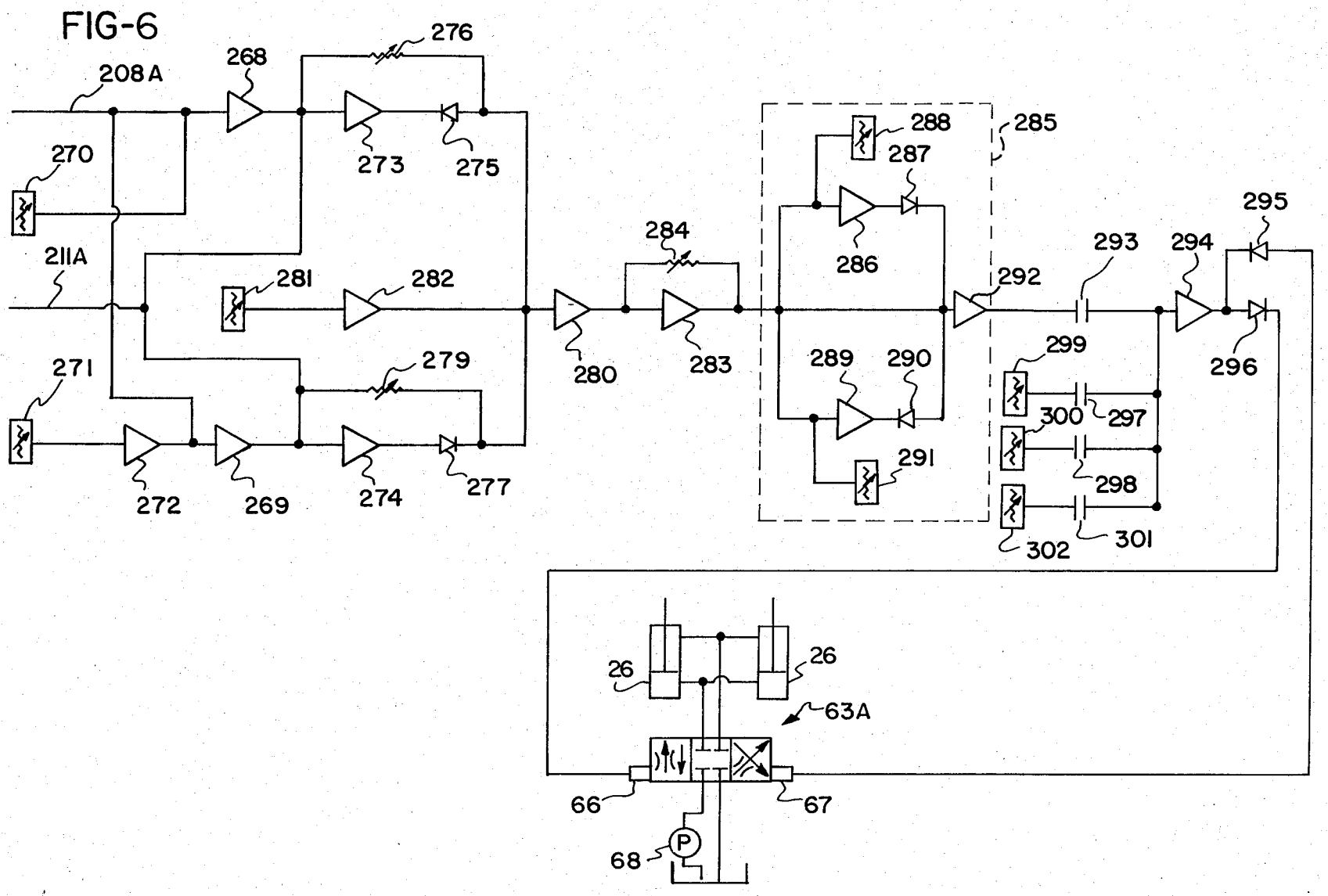
FIG. 6 is a schematic diagram of the packerhead lift control section of the combined concrete feed and packerhead lift control.

The portion of the combined concrete feed and packerhead lift control which is used to modulate the lift speed of the packerhead to overcome excessive overpack or underpack conditions is shown in FIG. 6. As previously noted, various changes during the operation of a packerhead machine can lead to overpack or underpack conditions within the sidewall of a concrete pipe being formed. The packerhead lift control shown in FIG. 6 operates to increase the lift rate of the packerhead toward a maximum lift speed when there is an excessive overpack condition and decrease the lift rate of the packerhead toward a minimum lift speed when there is an excessive underpack condition.

With reference to FIG. 6, the packerhead lift control includes a pair of summing and inverting operational amplifiers 268 and 269 which are connected to receive the positive motor load reference output signal by means of a conductor 208A which is connected to the conductor 208 from the computer controller 76 as shown in FIG. 5. A variable resistor or potentiometer 270 is connected to generate a positive overpack motor load signal defining a permissible overpack motor load portion. By summing the motor load reference signal and the overpack motor load signal, the operational amplifier 268 generates a motor load upper limit reference signal corresponding to the desired motor load defined by the motor load reference signal, plus the selected permissible overpack motor load portion defined by the overpack motor load signal.

A variable resistor or potentiometer 271 is connected to generate a positive underpack motor load signal defining a permissible underpack motor load portion. The positive underpack motor load signal from the potentiometer 271 is inverted by an inverter circuit 272 and passed to the input of the summing and inverting operational amplifier 269. The operational amplifier 269 algebraically sums the positive motor load reference signal and the negative underpack motor load signal to define a motor load lower limit reference signal corresponding to the desired motor load defined by the motor load reference signal less the selected permissible underpack motor load portion defined by the underpack motor load signal. The resulting motor load lower limit reference signal is inverted by the amplifier 269 to a negative signal.

Summing and inverting operational amplifiers 273 and 274 are connected to the conductor 211 by means of a conductor 211A to receive the actual motor load signal generated by the power transducer 74 (or 174) which is passed through the computer controller 76. A diode 275 is connected into the output path of the operational amplifier 273, and a feedback path is defined by a variable resistor or potentiometer 276. A diode 277 is connected into the output path of the operational amplifier 274, and a feedback path is defined by a variable resistor or potentiometer 279.

The operational amplifier 273 algebraically combines the positive actual motor load signal on the conductor 211A with the negative upper limit signal from the operational amplifier 268. In the event the actual motor load signal on the conductor 211A exceeds the upper limit signal from the operational amplifier 268, the output of the inverting operational amplifier 273 is a negative first lift control or overpack error signal which is passed through the diode 275 indicating that the upper motor load limit has been exceeded. Since positive signals will not be passed by the diode 275, its output signal is near zero volts except when the actual motor load signal exceeds the upper motor load limit signal.

In a similar manner, the operational amplifier 274 algebraically combines the negative lower limit signal from the operational amplifier 269 with the positive actual motor load signal on the conductor 211A. In the event the actual motor load signal falls below the lower limit signal, a negative signal is present on the input of the inverting operational amplifier 274 and a positive second lift control or underpack error signal is passed through the diode 277 indicating that the motor load has fallen below the lower limit. Since negative signals will not be passed by the diode 277, its output signal is near zero volts except when the actual motor load signal falls below the lower motor load limit signal.

Potentiometers 276 and 279 included within the feedback paths of the operational amplifiers 273 and 274, respectively, permit adjustment of the gain of the amplifiers 273 and 274 to provide a sensitivity adjustment for the error signals generated on their outputs to indicate that the upper and lower limits have been exceeded, respectively. The sensitivity adjustment enables an operator of the controlled packerhead machine to select how rapidly changes in the packerhead lift rate will be made in response to a given motor load in excess of the upper motor load limit or below the lower motor load limit. The negative overpack error signal from the operational amplifier 273 and the positive underpack error signal from the operational amplifier 274 are passed through the diodes 275 and 277, respectively, to the input of a summing and inverting operational amplifier 280. The error signals are connected to adjust the signal level of the input signal of the operational amplifier 280, which signal determines the lift speed of the packerhead of the pipe making machine.

A base packerhead lift speed is set by the machine operator by adjustment of a potentiometer 281. Adjustment of the potentiometer 281 generates a positive base packerhead lift speed voltage signal which is inverted by an operational amplifier 282 to generate a negative base packerhead lift speed signal which is passed to the input of the operational amplifier 280 together with both the negative overpack error signal from the diode 275 and the positive underpack error signal from the diode 277.

When the actual motor load is between the selected motor load upper limit and the motor load lower limit, there are no error signals passed by either diode 275 or diode 277. Accordingly, the output signal of the operational amplifier 280 is determined by the setting of the potentiometer 281 which defines the base packerhead lift speed. If the actual motor load exceeds the motor load upper limit reference, an overpack situation occurs and a negative overpack error signal is passed through the diode 275 to the input of the operational amplifier 280. Since the overpack error signal is negative, and the operational amplifier 280 algebraically combined the negative overpack error signal with the negative output of the operational amplifier 282, the magnitude of the negative input signal to the operational amplifier 280 is increased, and this results in a corrected lift speed output signal from the operational amplififer 280 which corresponds to a lift speed larger than the base packerhead lift speed defined by the potentiometer 281.

The magnitude of the overpack error signal, and hence, the increase in the packerhead lift speed signal at the output of the operational amplifier 280 is controlled by adjustment of the potentiometer 276. Adjustment of the potentiometer 276 to increase the gain of the operational amplifier 273, i.e., increase the sensitivity of the circuit to overpacking errors, will increase the value of the negative overpack error signal, and hence the corrected lift speed signal, and adjustment of the potentiometer 276 to decrease the gain of the operational amplifier 273, i.e., decrease the sensitivity of the circuit to overpacking errors, will decrease the value of the negative overpack error signal, and hence the corrected lift speed signal. These effects on the negative overpack error signal, and hence, the corrected lift speed signal are apparent by noting that for a given input error signal to the operational amplifier 273, adjustment of the potentiometer 276, and hence the gain of the operational amplifier 273, correspondingly adjust the magnitude of the negative overpack error signal. That is to say for a given input error signal, adjustment of the potentiometer 276 determines the size of the resulting overpack error signal.

On the other hand, if the actual motor load goes below the lower limit motor load reference, an underpack situation occurs and a positive underpack error signal is passed through the diode 277 to the operational amplifier 280. Since the operational amplifier 280 algebraically combines the positive underpack error signal from the diode 277 and the negative base packerhead lift speed signal from the operational amplifier 282, the resulting negative input to the operational amplifier is decreased such that the corrected packerhead lift speed signal at the output of the operational amplifier 280 is also decreased resulting in a reduced packerhead lift speed.

The magnitude of the underpack error signal, and hence, the decrease in the corrected lift speed signal at the output of the operational amplifier 280 is controlled by the adjustment of the potentiometer 279 in a manner similar to that described for overpacking. Adjustment of the potentiometer 279 for more sensitivity will increase the gain of the amplifier 274 and thereby generate a greater underpacking error signal for a given input error signal to more rapidly reduce the lift speed; whereas, adjustment for less sensitivity will reduce the gain of the amplifier 274 to thereby generate a smaller underpacking error signal for the same size input error signal to less rapidly increase the error signal, and hence, less rapidly reduce the lift speed of the packerhead. Here again, adjustment of the potentiometer 279 can be seen to determine the size of the underpacking error signal generated in response to a given size input error signal.

The packerhead lift speed signal from the operational amplifier 280 is passed to an inverting operational amplifier 283, the gain of which may be adjusted by a variable feedback resistor or potentiometer 284.

The circuitry 285 shown in a dotted line box defines lift speed range means for setting a maximum lift speed and a minimum lift speed for the packerhead. The lift speed range setting circuitry 285 comprises a summing and inverting amplifier 286 combined with a diode 287 in its output path, the combination being adjusted to have unity gain and allowing only positive signals to be passed from the amplifier 286. A variable resistor or potentiometer 288 is adjusted to provide a positive signal representative of the maximum allowed lift speed as an input signal to the operational amplifier 286. The operational amplifier 286 also receives as an input the negative output signal from the operational amplifier 283.

As long as the corrected lift speed signal from the operational amplifier 283 is less than the maximum allowed lift speed, the input signal to the operational amplifier 286 is positive, and hence, its output signal is negative and will not be passed by the diode 287 to a summing and inverting operational amplifier 292. However, when the corrected lift speed signal from the operational amplifier 283 is greater than the maximum allowed lift speed which is selected via the potentiometer 288, a positive error signal is generated at the output of the amplifier 286 and passed through the diode 287 to the amplifier 292. Because the combination of the amplifier 286 and the diode 287 produces unity gain, the error signal is equal to the difference between the preset maximum lift speed and the corrected lift speed, such that the operational amplifier 292 will combine the error signal and the corrected lift speed signal to generate a value equal to the maximum allowed lift speed as set by the potentiometer 288.

In a similar manner, a summing and inverting operational amplifier 289 is combined with a diode 290 in its output path, the combination being adjusted to have unity gain and allowing only negative signals to be passed from the amplifier 289. The amplifier 289 receives an input signal generated by a variable resistor or potentiometer 291 which is set to select a positive minimum allowed lift speed signal for the packerhead of a controlled pipe making machine. If the magnitude of the negative, corrected lift speed signal from the operational amplifier 283 is greater than the minimum allowed lift speed signal as selected by the setting of the potentiometer 291, the inverted result is a positive signal which will not be passed by the diode 290, and accordingly, a zero error is passed to the operational amplifier 292. On the other hand, if the corrected lift speed signal is smaller than the preset minimum allowed lift speed signal, a negative error signal is generated at the output of the operational amplifier 289 and passed by the diode 290 to the input of the operational amplifier 292. Since the combination of the amplifier 289 and the diode 290 produces unity gain, the error signal is equal to the difference between the corrected lift speed signal and the preset minimum allowed lift speed signal such that the operational amplifier 292 sums the signals to generate a signal equal to the minimum allowed lift speed signal.

The lift speed signal as corrected by the range limiting circuitry 285 is passed through a pair of normally open contacts 293 to a noninverting amplifier 294 which is a power amplifier and serves to amplify the signal levels sufficiently to drive the coils of the four-way proportional valve 63A. Negative signals at the output of the amplifier 294 are passed through the diode 295 to the down solenoid 67 of the four-way valve 63, while positive signals at the output of the amplifier 295 are passed through the diode 296 to the up solenoid 66 of the four-way proportional valve 63.

The operation of the packerhead lift control of FIG. 6 can now be described for production of a concrete pipe. With the packerhead at the bottom of the mold 118, an up order is generated by the computer controller 76, or other control circuitry, to close normally open contacts 293. A base lift speed for the packerhead is selected by adjustment of the potentiometer 281, and a base lift speed signal is passed through the the operational amplifiers 280, 282 and 283.

Assuming that no overpack or underpack error signals are passed through the diodes 275 and 277, and that the selected base packerhead lift speed is within the speed range defined by the circuitry 285, the negative base lift speed signal from the operational amplifier 283 is inverted by the operational amplifier 292 and passed through the closed cross-head up contacts 293 to the noninverting operational amplifier 294. Positive packerhead lift signals are passed from the output of the amplifier 294 through the diode 296 to the up solenoid 66 of the four-way proportional valve 63A. Under stable operating conditions of the packerhead machine, the four-way proportional valve 63A maintains the constant lift speed for the packerhead selected by adjustment of the potentiometer 281.

If an overpacking condition occurs, such that the actual motor load signal exceeds the upper motor load limit signal, a negative overpack error signal is passed through the diode 275 to the input of the operational amplifier 280 as previously described. The overpack error signal increases the magnitude of the negative input to the amplifier 280, and hence, increases the positive output of the operational amplifier 280. The four-way proportional valve 63A is thus adjusted to increase the lift speed of the packerhead by an amount proportional to the overpack error signal passed through the diode 275 and determined by the sensitivity setting of the potentiometer 276. The maximum packerhead lift speed is defined by the signal from the potentiometer 288 as previously described.

If the maximum lift speed of the packerhead is not limited, the packerhead may be raised at such a high speed, for example, due to a chunk of concrete falling into the mold, that the concrete is not sufficiently packed. This may effect the product to the point that it is destroyed when the mold is removed from a formed pipe. Although limiting the maximum lift speed may lead to isolated areas of heavy overpacking along a pipe where the torque may twist the reinforcing cage inside the pipe, such isolated twists will not affect the pipe. This is due to the fact that the resiliency of the cage is not sufficient to cause the cage to return to its original position and thereby shear the inside of the pipe such that it fails. By setting a maximum allowed lift speed, destruction of the product due to excessive lift speed is prevented, and under normal circumstances, by the time the lift speed has reached its maximum allowable value, the concrete conveyor has been completely stopped and all excessive concrete will be rapidly used such that the lift speed will generally start decreasing to return to a system balanced condition once again.

If an underpacking condition occurs, such that the actual motor load signal goes below the lower motor load limit signal, a positive underpack error signal is passed through the diode 277 to the input of the operational amplifier 280 with the magnitude of the underpack signal being determined by the sensitivity setting of the potentiometer 279 as previously described. This positive error signal reduces the negative base packerhead lift signal provided to the operational amplifier 280 such that the magnitude of the positive corrected packerhead lift signal generated by the operational amplifier 280 is reduced by a corresponding amount. The corrected packerhead lift signal is passed to the four-way proportional valve 63A to reduce the lift speed of the packerhead to overcome the underpacking condition. The minimum packerhead lift speed is defined by the signal from the potentiometer 291.

The minimum packerhead lift speed is normally set to a non-zero value which corresponds to the point where the packerhead lift is stopped. The non-zero value is required to compensate for a dead zone of the proportional valve 63 such that no substantial delay is encountered when the packerhead is once again to be lifted. In accordance with the present invention, when the concrete feed is interrupted or is greatly reduced due to a variety of reasons previously noted, the lift of the packerhead is to be stopped at a point where the upper edge of the rollers 36 of the packerhead head are at the level of the last part of the pipe produced 36A, i.e., just above the position of the packerhead shown in FIG. 3. This positioning of the packerhead is determined empirically or by trial and error by adjusting the underpack sensitivity potentiometer 279 to create an underpack error signal which is large enough to stop the lift of the packerhead at this point. Such settings of the potentiometer 279 must be determined for each size of pipe to be produced.

By stopping the lift of the packerhead at the point where the rollers 36 are at the level of the last part of the pipe produced, as soon as the concrete flow is restarted, the rollers once again start packing the incoming concrete and the packerhead starts rising without any gap area between the last made part of the pipe and the part of the pipe made by the new incoming concrete. Such gaps, which lead to unacceptable pipe, were created by previous control systems wherein the packerhead would be raised entirely out of the last part of the pipe before the packerhead lift is stopped. In such a situation, when the concrete feed is restarted, the packerhead commences lifting again and the gap area defined by the stop location of the packerhead is not properly packed resulting in unacceptable pipe.

When a new mold 18 is moved into position on a packerhead machine as shown in FIG. 1, the packerhead must be lowered through the mold before the production of a pipe within the mold can be commenced. When the packerhead is to be lowered, the cross-head up relay is released such that the normally open contacts 293 are opened and one of two cross-head down relays (not shown) is operated to close normally open contacts 297 or 298.

The normally open contacts 297 and 298 connect potentiometers 299 and 300 selectively to the input of the operational amplifier 294, with the negative signals from the potentiometers 299 and 300 providing two lowering speeds for the packerhead. In some applications, it may be desirable to provide a rapid, fixed lift speed for the second pass of the packerhead. In that event, a fixed lift speed relay including a normally open contact 301 and a fast rise potentiometer 302 may be provided.

The lowering speed of the packerhead near the top and the bottom of the mold where the packerhead passes close to the mold is set to a low speed by the potentiometer 299 to prevent potential contact with the mold and damage to the equipment. The packerhead lower speed through the central portion of the mold where packerhead clearances are greater is set to a higher speed defined by the potentiometer 300. Hence, the relays corresponding to the normally open contacts 297 and 298 are operated to select the appropriate one of the two cross-head down speeds defined by negative signals generated by the potentiometers 299 and 300. A crosshead position indicator (not shown) is used to inform the programmable computer controller 76 of the location of the packerhead in the mold.

Figure 7:
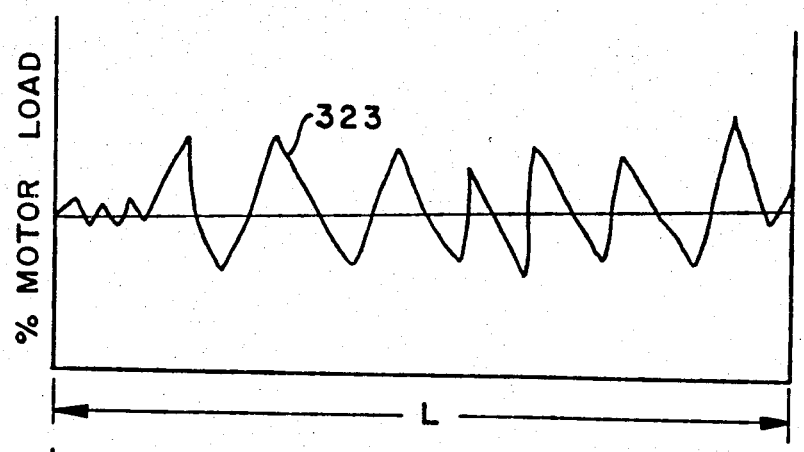
FIG. 7 is a diagram showing variations in the percentage of motor load of the packerhead drive motor with a conventional manually operated concrete feed control.

FIG. 7 is a graphic representation of the variations in motor load when a packerhead machine is manually rather than automatically controlled. The variations in motor load represented by the line 323 are due to the inability of an operator to compensate quickly enough for variations in concrete feed/concrete packing pressure which occur during manual control of a packerhead machine.

Figure 8:
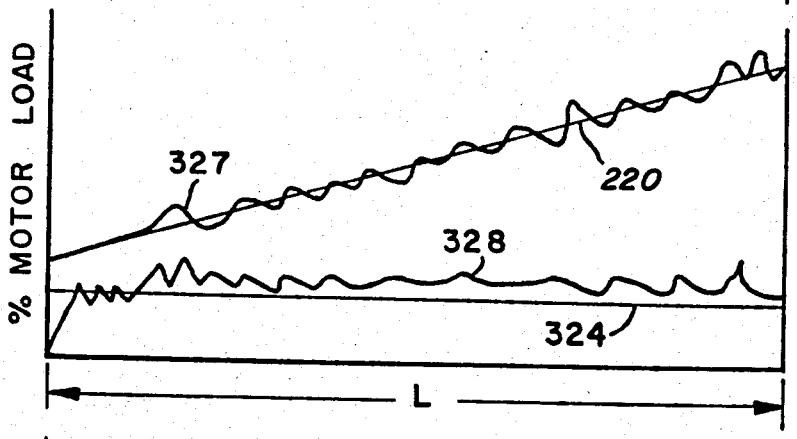
FIG. 8 is a diagram showing the motor load variations for an overspeed setting of the concrete conveyor and a corrected concrete conveyor speed.

FIG. 8 is a graphic representation of the motor load which would result if the concrete conveyor is operated at a speed faster than the ideal speed and how the motor load is reduced when the conveyor speed is throttled back to a corrected or desired speed by the disclosed control circuit of FIG. 5. A first motor load line 324 represents the desired motor load if the exact amount of concrete required was provided to the machine. A second motor load line 220, which continuously increases relative to the first line 324 along the length L of a pipe being formed, represents the ideal increase in motor load which would be encountered if the concrete conveyor was allowed to overspeed continuously. Variations in the motor load relative to the line 220 are represented by the line 327. In accordance with the present invention, the speed of the conveyor is reduced or throttled back to move the motor load line down toward the line 324. The corrected motor load is represented by the line 328, which follows and is slightly above the line 324.

Figure 9:
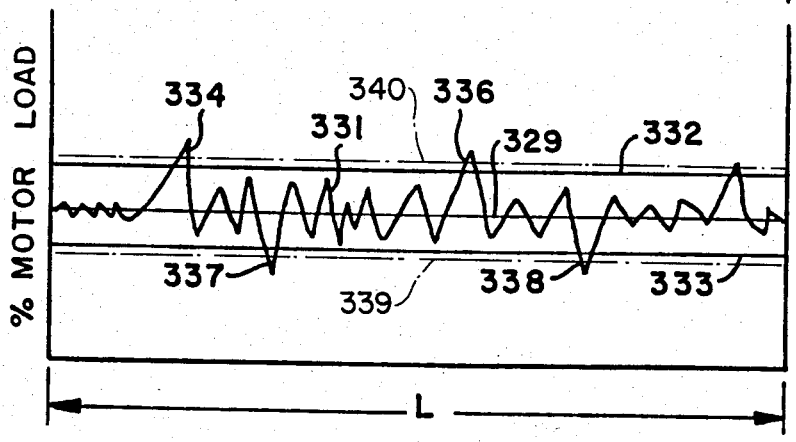
FIG. 9 is a diagram showing the motor load variations for the corrected conveyor speed without modulation of the packerhead lift speed.

FIG. 9 is a graphic representation of the motor load with an automatic feed control without the packerhead lift speed modulation of the present invention. A line 329 represents the selected packing pressure in terms of motor load. The variations of motor load are represented by a line 331 which generally follows the line 329 between a selected upper limit motor load line 332 representative of the maximum overpacking tolerated before modulation of the packerhead lift speed is commenced and a selected lower limit motor load line 333 representative of the maximum underpacking tolerated before modulation of the packerhead lift speed is commenced. Portions 334, 336, 337 and 338 of the line 331 fall outside the upper and lower limit lines 332 and 333. In particular, portions 334 and 336 are above the upper limit line 332 and portions 337 and 338 are below the lower limit line 333. The portions 334 and 336 represent overpacking conditions beyond desirable limits and the portions 337 and 338 represent underpacking conditions beyond desirable limits.

The dash-dot lines 339, 340 in FIG. 9 represent underpack and overpack motor load levels beyond which pipe should not be made. Accordingly, as the motor load approaches the line 339, the packerhead lift should be stopped with the packerhead substantially within the produced portion of the pipe as previously described in accordance with the present invention.

Figure 10:
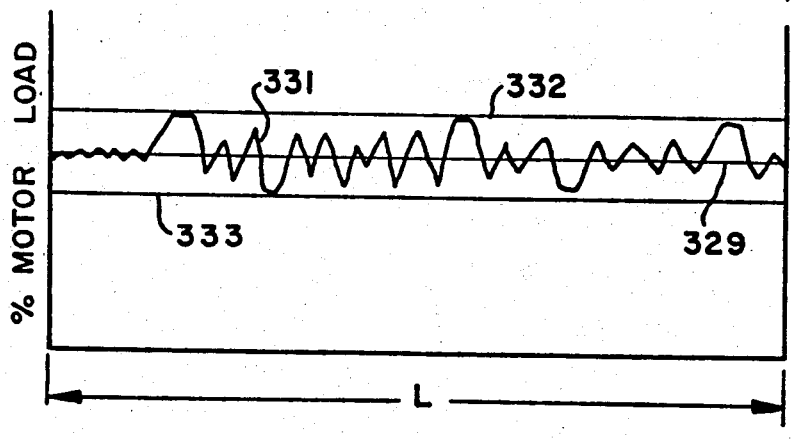
FIG. 10 is a diagram similar to FIG. 9 showing motor load variations with the combined control of the packerhead lift speed and the concrete feed control of the present invention.

FIG. 10 is a graphic representation of the correction of the overpacking and underpacking conditions by the control system of the present invention for a typical pipe making cycle of operation. As can be seen, the motor load line 331 is maintained between the upper limit and lower limit motor load lines 332 and 333 during formatiqn of the concrete pipe.

While there has been shown and described an automatic concrete feed and modulated packerhead lift control, it is understood that changes in the apparatus and electrical and hydraulic circuits may be made by those skilled in the art without departing from the invention which is defined in the following claims.

What is claimed is:

1. In a packerhead pipe making machine having a packerhead which is simultaneously rotated by a packerhead motor and lifted by variable speed lift means to form a concrete pipe within a vertically oriented mold from concrete that is deposited into the mold on top of the packerhead by a conveyor driven by a variable speed conveyor motor, a control for the combined regulation of the operating speed of the conveyor and the lift speed of the packerhead to maintain the density of the pipe substantially uniformly between predetermined limits of overpacking and underpacking, comprising:

(a) transducer means for sensing the power used to rotate the packerhead and for generating a sensed packerhead motor load signal representative of said sensed power;

(b) first adjustable means for selecting a reference motor load signal defining a desired motor load;

(c) first circuit means for combining said sensed packerhead motor load signal and said motor load reference signal to generate a conveyor control signal;

(d) second adjustable means for setting a conveyor speed reference signal;

(e) conveyor control means for controlling the speed of operation of the conveyor motor in response to said conveyor speed reference signal and said conveyor control signal and thereby regulating the speed of operation of the conveyor and the discharge of concrete into the mold;

(f) third adjustable means for selecting an overpack motor load signal defining a permissible overpack motor load portion;

(g) second circuit means responsive to said reference motor load signal and said overpack motor load signal for generating an upper limit reference signal corresponding to said desired motor load plus the selected permissible overpack motor load portion;

(h) fourth adjustable means for selecting an underpack motor load signal defining a permissible underpack motor load portion;

(i) third circuit means responsive to said reference motor load signal and said underpack motor load signal for generating a lower limit reference signal corresponding to said desired motor load less the selected permissible underpack motor load portion;

(j) fourth circuit means for combining said packerhead motor load signal and said upper limit reference signal to generate a first lift control signal when said sensed motor load signal exceeds said upper limit reference signal;

(k) fifth circuit means for combining the packerhead motor load signal and said lower limit reference signal to generate a second lift control signal when said sensed motor load signal falls below said lower limit reference signal;

(l) fifth adjustable means for setting a base packerhead lift speed signal; and (m) lift control means responsive to said base packerhead lift speed signal and said first and second lift control signals for maintaining the lift speed of the packerhead at a substantially constant equal to said base speed when said sensed motor load signal is between said limit reference signals, for increasing the lift speed of the packerhead above said constant speed when said sensed motor load signal exceeds said upper limit reference signal and for decreasing the lift speed of the packerhead below said constant speed when said sensed motor load signal falls below said lower limit reference signal, said lift control means including lift speed range means for setting a maximum lift speed and a minimum lift speed for said packerhead;

(n) whereby so long as said sensed motor load signal remains between said upper and lower limit reference signals, said lift control means maintains a substantially constant lift speed of the packerhead but upon generation of either of said first and second lift control signals, the lift speed of the packerhead will be increased or decreased correspondingly within a lift speed range defined between said maximum lift speed and said minimum lift speed.

2. The combination defined in claim 1 wherein said fifth circuit means includes sixth adjustable means which is set to correspond to the pipe size being produced such that if the packerhead lift speed is reduced to zero, the packerhead will remain substantially within the last part of the pipe being produced.

3. The combination as defined in claim 1 wherein said packerhead motor is a hydraulic motor driven by a hydraulic pump which is driven by a pump motor, and said transducer means comprises a Hall effect watt transducer that senses the power used by said pump motor.

4. The combination defined in claim 1 wherein said variable speed lift means are hydraulic, and said lift control means include proportional valve means operable to control the flow of fluid under pressure to said lift means, and solenoid means operable in response to said lift control signals to control said valve means and thereby to regulate the lift speed of the packerhead.

5. In a packerhead pipe making machine having a packerhead which is simultaneously rotated by a packerhead motor and lifted by variable speed lift means to form a concrete pipe within a vertically oriented mold from concrete that is deposited into the mold on top of the packerhead by a conveyor driven by a variable speed conveyor motor, a control for coordinating the regulation of the speed of the conveyor and the lift speed of the packerhead to maintain the density of the pipe substantially uniformly between predetermined limits of overpacking and underpacking, comprising:

(a) first means for sensing the power used to rotate the packerhead and for generating a packerhead motor load signal representative of the sensed power;

(b) second means responsive to said packerhead motor load signal to control the speed of the conveyor motor and thereby to control the rate at which concrete is discharged by the conveyor into the mold; and (c) third means for maintaining the lift speed of the packerhead substantially constant during variations of said packerhead motor load signal between a selected upper limit packerhead motor load signal and a selected lower limit packerhead motor load signal; and (d) said third means further providing for increasing the lift speed of the packerhead up to a selected maximum lift speed in response to an increase of said packerhead motor load signal above said upper limit signal and for decreasing the lift speed of the packerhead down to a selected minimum lift speed in response to a decrease of said packerhead motor load signal below said lower limit signal.

6. The combination defined in claim 5 wherein said third means includes adjustable means which is set to correspond to the pipe size being produced such that if the packerhead lift speed is reduced to zero, the packerhead will remain substantially within the last part of the pipe being produced.

7. The combination defined in claim 5 wherein said second means comprise:

(a) a conveyor speed signal generator for generating a preset conveyor speed signal;

(b) a reference generator for generating a packerhead motor load reference signal;

(c) first circuit means for combining said sensed packerhead motor load signal and said packerhead motor load reference signal to generate a preset conveyor control signal; and (d) second circuit means for controlling the speed of said conveyor in response to said preset conveyor speed signal and said conveyor control signal.

8. The combination defined in claim 7 wherein said reference generator includes adjustable means operable to change said packerhead motor load reference signal.

9. The combination defined in claim 5 wherein said third means comprise:

(a) first reference means for generating an upper packerhead motor load limit signal corresponding to a desired motor load plus a selected permissible overpack motor load portion;

(b) second reference means for generating a lower packerhead motor load limit signal corresponding to said desired motor load less a selected permissible motor load portion;

(c) first circuit means for combining said sensed packerhead motor load signal with said upper load limit signal to generate a first lift control signal when said sensed motor load signal exceeds said upper load limit signal;

(d) second circuit means for combining said sensed motor load signal with said lower load limit signal to generate a second lift control signal when said sensed motor load signal falls below said lower load limit signal; and (e) lift control means for increasing the lift speed of the packerhead up to a selected maximum lift speed in response to said first lift control signal and for decreasing the lift speed of the packerhead down to a selected minimum lift speed in response to said second lift control signal.

10. The combination defined in claim 9 wherein said first and second reference means are adjustable to generate load limit signals of selected values above and below said desired motor load.

11. The combination defined in claim 10 wherein said second circuit means includes adjustable means which is set to correspond to the pipe size being produced such that if the packerhead lift speed is reduced to zero, the packerhead will remain substantially within the last part of the pipe being produced.

12. A method for making concrete pipe with a machine having a packerhead for forming concrete pipe in a vertically oriented mold, packerhead motor means for rotating the packerhead, lift means for moving the packerhead in an upward direction through the mold, and conveyor means driven by a conveyor motor for supplying concrete to the mold, said method comprising the steps of:

locating the packerhead in the lower end of the mold;

discharging concrete from the conveyor means into the mold while simultaneously rotating and lifting the packerhead relative to the mold to form a concrete pipe therein;

sensing the power used by the packerhead motor means to rotate the packerhead and providing a packerhead motor load signal representative of the power used;

controlling the amount of concrete discharged into the mold by varying the operating speed of the conveyor motor as a function of the packerhead motor load signal;

providing a packerhead motor load upper limit reference signal and a packerhead motor load lower limit reference signal; and varying the lift speed of the packerhead within a range between a selected maximum lift speed and a selected minimum lift speed when the packerhead motor load exceeds the upper limit reference signal or falls below the lower limit reference signal whereby the density of the concrete pipe formed within the mold is substantially uniform throughout its length.

13. The method of claim 12 wherein the step of varying the lift speed of the packerhead comprises:

increasing the lift speed of the packerhead toward said maximum lift speed if the packerhead motor load signal exceeds the upper limit reference signal; and decreasing the lift speed of the packerhead toward said minimum lift speed if the packerhead motor load signal falls below the lower limit reference signal whereby the lift speed of the packerhead is modulated concurrently with the control of the speed of the conveyor means if the packerhead motor load signal extends beyond the upper or lower limit reference signals.

14. The method of claim 12 wherein the step of controlling the amount of concrete discharged into the mold comprises:

setting a motor load reference signal for defining a desired motor load;

comparing the packerhead motor load signal to the motor load reference signal to generate a motor load error signal;

setting a conveyor speed reference signal which controls the conveyor motor to drive the conveyor means at a speed which is faster than a desired speed; and reducing the conveyor speed reference signal by error signals generated when the motor load signal exceeds the motor load reference signal to throttle back the speed of the conveyor motor and thereby to maintain the speed of the conveyor means at substantially the desired speed.

15. The method of claim 12 wherein the minimum speed of the packerhead is equal to zero and the step of decreasing the lift speed of the packerhead is performed such that if the minimum speed is attained, the packerhead remains substantially within the last part of the pipe being produced.

* * * * *